US008290775B2

(12) United States Patent
Etezadi et al.

(10) Patent No.: US 8,290,775 B2
(45) Date of Patent: Oct. 16, 2012

(54) PRONUNCIATION CORRECTION OF TEXT-TO-SPEECH SYSTEMS BETWEEN DIFFERENT SPOKEN LANGUAGES

(75) Inventors: Cameron Ali Etezadi, Bellevue, WA (US); Timothy David Sharpe, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 975 days.

(21) Appl. No.: 11/824,491

(22) Filed: Jun. 29, 2007

(65) Prior Publication Data

US 2009/0006097 A1 Jan. 1, 2009

(51) Int. Cl.
*G10L 13/08* (2006.01)
*G10L 21/00* (2006.01)

(52) U.S. Cl. ..... 704/260; 704/277; 704/231

(58) Field of Classification Search ..... 704/8, 260, 704/277, 231

See application file for complete search history.

(56) References Cited

U.S. PATENT DOCUMENTS

| | | | | |
|---|---|---|---|---|
| 5,799,276 | A * | 8/1998 | Komissarchik et al. | 704/251 |
| 5,802,539 | A | 9/1998 | Daniels et al. | 715/236 |
| 6,076,060 | A | 6/2000 | Lin et al. | 704/260 |
| 6,078,885 | A | 6/2000 | Beutnagel | 704/258 |
| 6,188,984 | B1 * | 2/2001 | Manwaring et al. | 704/260 |
| 6,973,427 | B2 | 12/2005 | Hwang et al. | 704/249 |
| 7,149,688 | B2 * | 12/2006 | Schalkwyk | 704/255 |
| 7,315,811 | B2 * | 1/2008 | Cote et al. | 704/9 |
| 7,406,408 | B1 * | 7/2008 | Lackey et al. | 704/8 |
| 7,472,061 | B1 * | 12/2008 | Alewine et al. | 704/243 |
| 7,716,050 | B2 * | 5/2010 | Gillick et al. | 704/254 |
| 2004/0236581 | A1 | 11/2004 | Ju et al. | 704/276 |
| 2005/0144003 | A1 | 6/2005 | Iso-Sipila | 704/269 |
| 2005/0197837 | A1 | 9/2005 | Suontausta et al. | 704/260 |
| 2007/0118377 | A1 * | 5/2007 | Badino et al. | 704/260 |
| 2007/0233490 | A1 * | 10/2007 | Yao | 704/260 |
| 2007/0255567 | A1 * | 11/2007 | Bangalore et al. | 704/260 |
| 2008/0052077 | A1 * | 2/2008 | Bennett et al. | 704/257 |

FOREIGN PATENT DOCUMENTS

| | | | |
|---|---|---|---|
| EP | 1291848 | A2 | 3/2003 |
| KR | 2003-0097297 | A | 12/2003 |

OTHER PUBLICATIONS

Leonardo et al., "A General Approach to TTS Reading of Mixed-Language Texts", http://www.cstr.ed.ac.uk/downloads/publications/2004/WeA2401o.5_p1083.pdf, Published Date: 2004, 4 pp.*

(Continued)

*Primary Examiner* — Angela A Armstrong
(74) *Attorney, Agent, or Firm* — Merchant & Gould

(57) ABSTRACT

Pronunciation correction for text-to-speech (TTS) systems and speech recognition (SR) systems between different languages is provided. If a word requiring pronunciation by a target language TTS or SR is from a same language as the target language, but is not found in a lexicon of words from the target language, a letter-to-speech (LTS) rules set of the target language is used to generate a letter-to-speech output for the word for use by the TTS or SR configured according to the target language. If the word is from a different language as the target language, phonemes comprising the word according to its native language are mapped to phonemes of the target language. The phoneme mapping is used by the TTS or SR configured according to the target language for generating or recognizing an audible form of the word according to the target language.

19 Claims, 5 Drawing Sheets

OTHER PUBLICATIONS

Vitale, "An Algorithm for High Accuracy Name Pronunciation by Parametric Speech Synthesizer" http://www.aclweb.org/anthology/J/J91/J91-3OOI.pdf, Published Date: 1991, 20 pp.*

Vitale, "An Algorithm for High Accuracy Name Pronunciation by Parametric Speech Synthesizer", http://www.aclweb.org/anthology/J/J91/J91-3001.pdf, Published Date: 1991, 20 pp.

Bandino et al., "Language Independent Phoneme Mapping for Foreign TTS", http://www.cstr.ed.ac.uk/downloads/publications/2004/2026.pdf, Published Date: 2004, 2 pp.

Bandino et al., "A General Approach to TTS Reading of Mixed-Language Texts", http://www.cstr.ed.ac.uk/downloads/publications/2004/WeA2401o.5_p1083.pdf, Published Date: 2004, 4 pp.

Davel et al., "Developing Consistent Pronunciation Models for Phonemic Variants", http://www.meraka.org.za/pubs/dave106developing.pdf, Published Date: 2006, 4 pp.

International Search Report dated Dec. 19, 2008 for PCT Application Serial No. PCT/US2008/067947.

* cited by examiner

*Mobile Computing Device*

PRONUNCIATION CORRECTION OF TEXT-TO-SPEECH SYSTEMS BETWEEN DIFFERENT SPOKEN LANGUAGES

BACKGROUND OF THE INVENTION

Software developers often make a single software application or program available in multiple languages via the use of resource files which allow an application to look up text strings used by a reference identification for retrieving a correct text string version for a language in use. The correct text string version for the in-use language is then displayed for a user via a graphical user interface associated with a software application. Speech-based systems add an additional layer of complexity to the provision of software applications in multiple languages. For speech-based systems, not only do text strings need to be modified on a per language basis, but differences in the rules of pronunciations between spoken languages must be addressed. In addition, all languages do not share the same basic phonemes, which are sets of sounds used to form syllables and ultimately words. In the case of text-to-speech systems and speech recognition systems, if there is not a match between a given text language and the language in use by the text-to-speech system or speech recognition system, the results of audible input are often incorrect, unintelligible, or even useless. For example, if the English language text string "The Beatles," a famous British music group, is passed to a text-to-speech system or speech recognition system operating according to the German language, the text-to-speech (TTS) and/or speech recognition system may not be able to convert the English-based text string or recognize the English-based text string because the German-based TTS and/or speech recognition systems expect a pronunciation of the form "Za Bay-tuls" which is incorrect. This incorrect outcome is caused by the fact that the phoneme "th" does not exist in the German language, and the pronunciation rules are different for English and German languages which causes an expected pronunciation for other portions of the text string to be incorrect.

It is with respect to these and other considerations that the present invention has been made.

SUMMARY OF THE INVENTION

This summary is provided to introduce a selection of concepts in a simplified form that are further described below in the detailed description. This summary is not intended to identify key features or essential features of the claimed subject matter, nor is it intended as an aid in determining the scope of the claimed subject matter.

Embodiments of the present invention solve the above and other problems by providing pronunciation correction of text-to-speech systems and speech recognition systems between different languages. When a word or phrase requires text-to-speech conversion or speech recognition, a search of a word lexicon associated with the TTS system or speech recognition system is conducted. If a matching word is found, the matching word is converted to an audible form, or recognition is performed on the matching word. If a matching word is not found, locale data for the word requiring pronunciation is determined. If the locale of the word requiring pronunciation matches a locale for the TTS and/or speech recognition systems, then a letter-to-speech (LTS) rules system is utilized for creating an audible form of the word or for recognizing the word.

If the locale for the word requiring pronunciation is different from a locale of a TTS and/or speech recognition system in use, a lexicon service is queried to obtain a mapping of the phonemes associated with the word requiring pronunciation to corresponding phonemes of the language associated with the TTS and/or speech recognition system responsible for translating the word from text-to-speech or for recognizing the word. The phonemes associated with the language of the TTS and/or speech recognition system to which the phonemes of the incoming word are mapped are then used for generating an audible form of the incoming word or for recognizing the incoming word based on a pronunciation of the incoming word that may be understood by the TTS and/or speech recognition system that is in use.

These and other features and advantages will be apparent from a reading of the following detailed description and a review of the associated drawings. It is to be understood that both the foregoing general description and the following detailed description are explanatory only and are not restrictive of the invention as claimed.

DETAILED DESCRIPTION

As briefly described above, pronunciation correction for text-to-speech (TTS) systems and speech recognition (SR) systems between different languages is provided. Generally described, if a word requiring pronunciation by a target language TTS or SR is from a same language as the target language, but is not found in a lexicon of words from the target language, a letter-to-speech (LTS) rules set of the target language is used to generate a letter-to-speech output for the word for use by the TTS or SR configured according to the target language. If the word is from a different language as the target language, phonemes comprising the word according to its native language are mapped to phonemes of the target language. The phoneme mapping is used by the TTS or SR configured according to the target language for generating or recognizing an audible form of the word according to the target language.

As briefly described above, embodiments of the present invention may be utilized for both mobile and wired computing devices. For purposes of illustration, embodiments of the present invention will be described herein with reference to a mobile device 100 having a system 200, but it should be appreciated that the components described for the mobile computing device 100 with its mobile system 200 are equally applicable to a wired device having similar or equivalent functionality.

Figure 1:
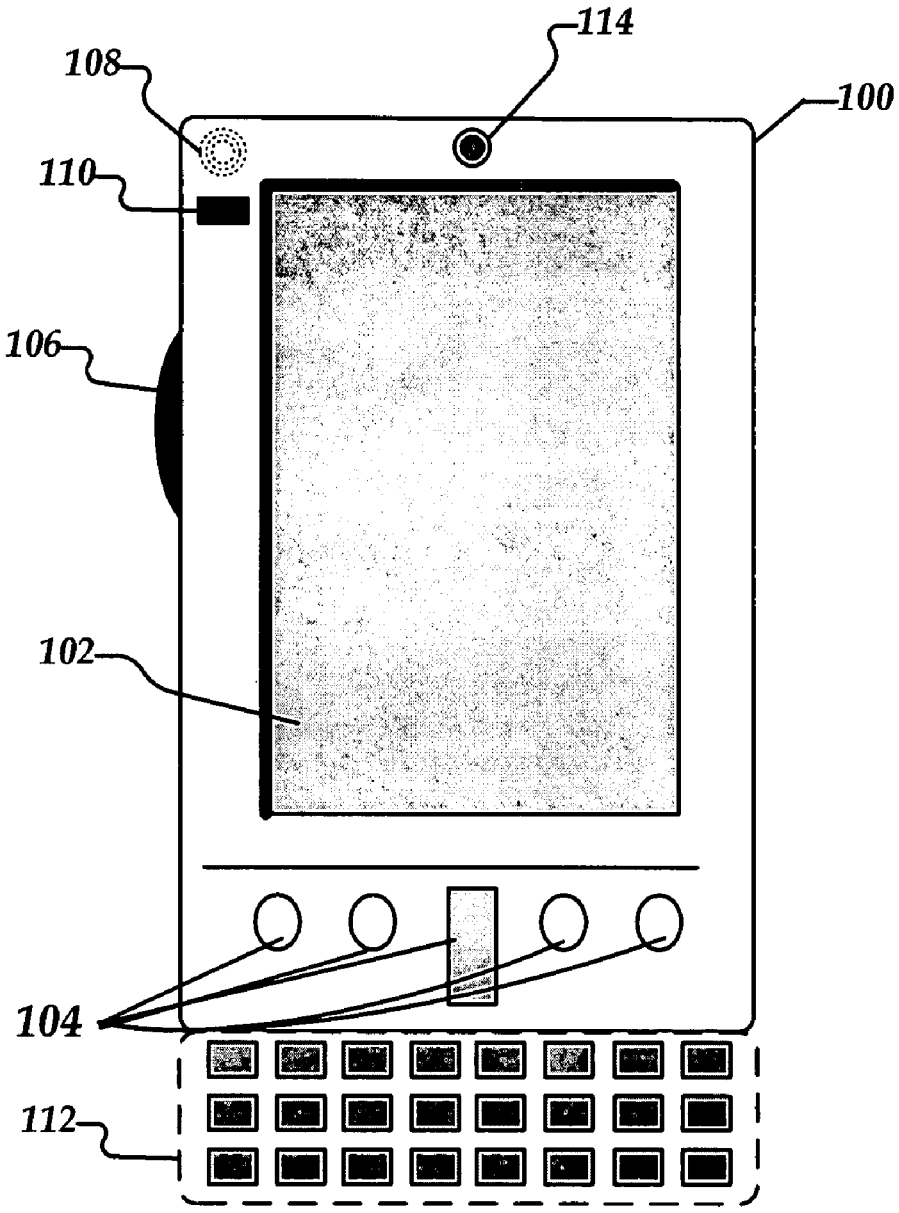
FIG. 1 is a diagram of an example mobile telephone/computing device.

The following is a description of a suitable mobile device, for example, the camera phone or camera-enabled computing device, discussed above, with which embodiments of the invention may be practiced. With reference to FIG. 1, an example mobile computing device 100 for implementing the embodiments is illustrated. In a basic configuration, mobile computing device 100 is a handheld computer having both input elements and output elements. Input elements may include touch screen display 102 and input buttons 104 and allow the user to enter information into mobile computing device 100. Mobile computing device 100 also incorporates a side input element 106 allowing further user input. Side input element 106 may be a rotary switch, a button, or any other type of manual input element. In alternative embodiments, mobile computing device 100 may incorporate more or less input elements. For example, display 102 may not be a touch screen in some embodiments. In yet another alternative embodiment, the mobile computing device is a portable phone system, such as a cellular phone having display 102 and input buttons 104. Mobile computing device 100 may also include an optional keypad 112. Optional keypad 112 may be a physical keypad or a "soft" keypad generated on the touch screen display. Yet another input device that may be integrated to mobile computing device 100 is an on-board camera 114.

Mobile computing device 100 incorporates output elements, such as display 102, which can display a graphical user interface (GUI). Other output elements include speaker 108 and LED light 110. Additionally, mobile computing device 100 may incorporate a vibration module (not shown), which causes mobile computing device 100 to vibrate to notify the user of an event. In yet another embodiment, mobile computing device 100 may incorporate a headphone jack (not shown) for providing another means of providing output signals.

Although described herein in combination with mobile computing device 100, in alternative embodiments the invention is used in combination with any number of computer systems, such as in desktop environments, laptop or notebook computer systems, multiprocessor systems, micro-processor based or programmable consumer electronics, network PCs, mini computers, main frame computers and the like. Embodiments of the invention may also be practiced in distributed computing environments where tasks are performed by remote processing devices that are linked through a communications network in a distributed computing environment; programs may be located in both local and remote memory storage devices. To summarize, any computer system having a plurality of environment sensors, a plurality of output elements to provide notifications to a user and a plurality of notification event types may incorporate embodiments of the present invention.

Figure 2:
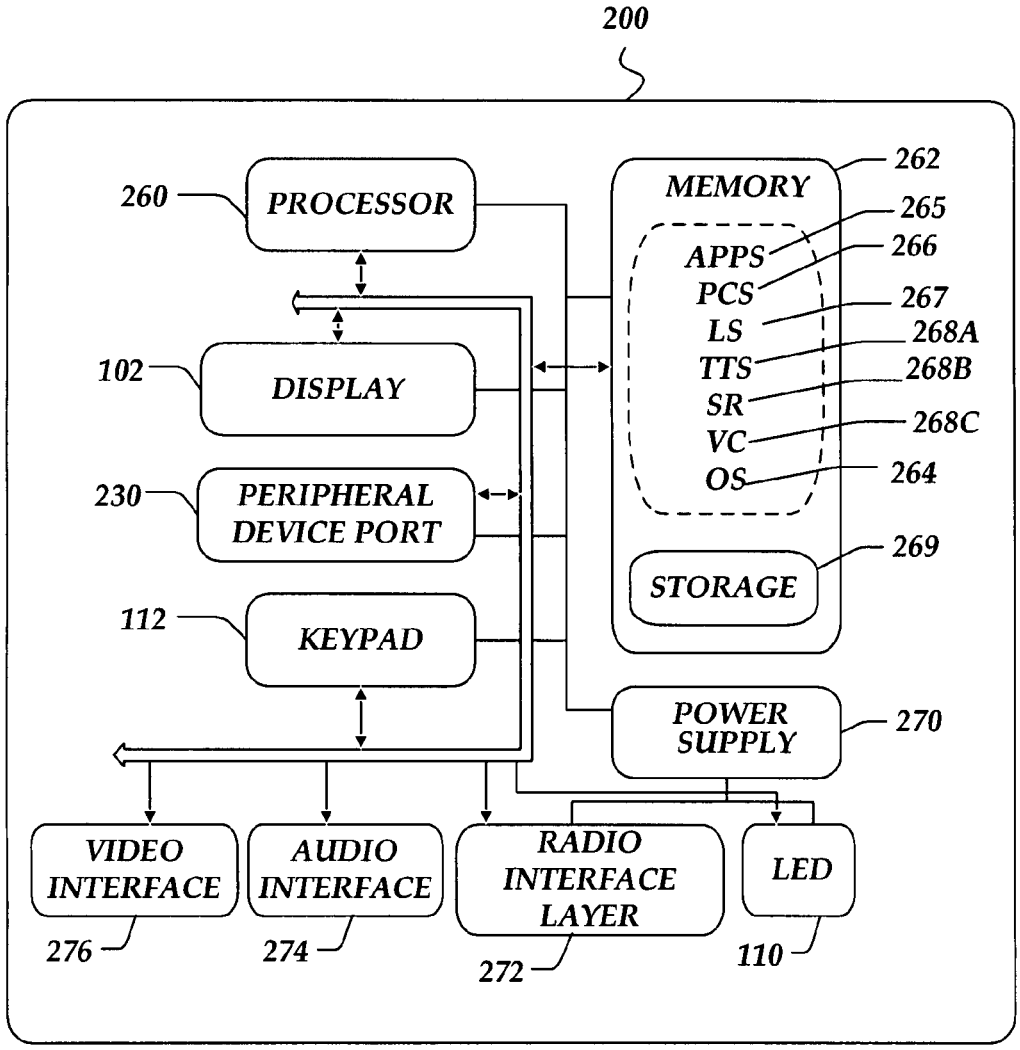
FIG. 2 is a block diagram illustrating components of a mobile telephone/computing device that may serve as an operating environment for the embodiments of the invention.

FIG. 2 is a block diagram illustrating components of a mobile computing device used in one embodiment, such as the mobile telephone/computing device 100 illustrated in FIG. 1. That is, mobile computing device 100 (FIG. 1) can incorporate system 200 to implement some embodiments. For example, system 200 can be used in implementing a "smart phone" that can run one or more applications similar to those of a desktop or notebook computer such as, for example, browser, email, scheduling, instant messaging, and media player applications. System 200 can execute an Operating System (OS) such as, WINDOWS XP®, WINDOWS MOBILE 2003® or WINDOWS CE® available from MICROSOFT CORPORATION, REDMOND, Wash. In some embodiments, system 200 is integrated as a computing device, such as an integrated personal digital assistant (PDA) and wireless phone.

In this embodiment, system 200 has a processor 260, a memory 262, display 102, and keypad 112. Memory 262 generally includes both volatile memory (e.g., RAM) and non-volatile memory (e.g., ROM, Flash Memory, or the like). System 200 includes an Operating System (OS) 264, which in this embodiment is resident in a flash memory portion of memory 262 and executes on processor 260. Keypad 112 may be a push button numeric dialing pad (such as on a typical telephone), a multi-key keyboard (such as a conventional keyboard), or may not be included in the mobile computing device in deference to a touch screen or stylus. Display 102 may be a liquid crystal display, or any other type of display commonly used in mobile computing devices. Display 102 may be touch-sensitive, and would then also act as an input device.

One or more application programs 265 are loaded into memory 262 and run on or outside of operating system 264. Examples of application programs include phone dialer programs, e-mail programs, PIM (personal information management) programs, such as electronic calendar and contacts programs, word processing programs, spreadsheet programs, Internet browser programs, and so forth. System 200 also includes non-volatile storage 268 within memory 262. Non-volatile storage 269 may be used to store persistent information that should not be lost if system 200 is powered down. Applications 265 may use and store information in non-volatile storage 269, such as e-mail or other messages used by an e-mail application, contact information used by a PIM, documents used by a word processing application, and the like. A synchronization application (not shown) also resides on system 200 and is programmed to interact with a corresponding synchronization application resident on a host computer to keep the information stored in non-volatile storage 269 synchronized with corresponding information stored at the host computer. In some embodiments, non-volatile storage 269 includes the aforementioned flash memory in which the OS (and possibly other software) is stored.

A pronunciation correction system (PCS) 266 is operative to correct pronunciation of text-to-speech (TTS) systems and speech recognition systems between different spoken languages, as described herein. The PCS 266 may apply letter-to-speech (LTS) rules sets and call the services of a lexicon service (LS) 267, as described below with reference to FIGS. 3-5.

The text-to-speech (TTS) system 268A is a software application operative to receive text-based information and to generate an audible announcement from the received information. As is well known to those skilled in the art, the TTS system 268A may access a large lexicon or library of spoken words, for example, names, places, nouns, verbs, articles, or any other word of a designated spoken language for generating an audible announcement for a given portion of text. The lexicon of spoken words may be stored at storage 269. According to embodiments of the present invention, once an audible announcement is generated from a given portion of text, the audible announcement may be played via the audio interface 274 of the telephone/computing device 100 through a speaker, earphone or headset associated with the telephone 100.

The speech recognition (SR) system 268B is a software application operative to receive an audible input from a called or calling party and for recognizing the audible input for use in call disposition by the ICDS 300. Like the TTS system 268A, the speech recognition module may utilize a lexicon or library of words it has been trained to understand and to recognize.

The voice command (VC) module 268C is a software application operative to receive audible input at the device 100 and to convert the audible input to a command that may be used to direct the functionality of the device 100. According to one embodiment, the voice command module 268C may be comprised of a large lexicon of spoken words, a recognition function and an action function. The lexicon of spoken words may be stored at storage 269. When a command is spoken into a microphone of the telephone/computing device 100, the voice command module 268C receives the spoken command and passes the spoken command to a recognition function that parses the spoken words and applies the parsed spoken words to the lexicon of spoken words for recognizing each spoken word. Once the spoken words are recognized by the recognition function, a recognized command, for example, "forward this call to Joe," may be passed to an action functionality that may be operative to direct the call forwarding activities of a mobile telephone/computing device 100.

System 200 has a power supply 270, which may be implemented as one or more batteries. Power supply 270 might further include an external power source, such as an AC adapter or a powered docking cradle that supplements or recharges the batteries.

System 200 may also include a radio 272 that performs the function of transmitting and receiving radio frequency communications. Radio 272 facilitates wireless connectivity between system 200 and the "outside world", via a communications carrier or service provider. Transmissions to and from radio 272 are conducted under control of OS 264. In other words, communications received by radio 272 may be disseminated to application programs 265 via OS 264, and vice versa.

Radio 272 allows system 200 to communicate with other computing devices, such as over a network. Radio 272 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

This embodiment of system 200 is shown with two types of notification output devices. The LED 110 may be used to provide visual notifications and an audio interface 274 may be used with speaker 108 (FIG. 1) to provide audio notifications. These devices may be directly coupled to power supply 270 so that when activated, they remain on for a duration dictated by the notification mechanism even though processor 260 and other components might shut down for conserving battery power. LED 110 may be programmed to remain on indefinitely until the user takes action to indicate the powered-on status of the device. Audio interface 274 is used to provide audible signals to and receive audible signals from the user. For example, in addition to being coupled to speaker 108, audio interface 274 may also be coupled to a microphone to receive audible input, such as to facilitate a telephone conversation. In accordance with embodiments of the present invention, the microphone may also serve as an audio sensor to facilitate control of notifications, as will be described below.

System 200 may further include video interface 276 that enables an operation of on-board camera 114 (FIG. 1) to record still images, video stream, and the like. According to some embodiments, different data types received through one of the input devices, such as audio, video, still image, ink entry, and the like, may be integrated in a unified environment along with textual data by applications 265.

A mobile computing device implementing system 200 may have additional features or functionality. For example, the device may also include additional data storage devices (removable and/or non-removable) such as, magnetic disks, optical disks, or tape. Such additional storage is illustrated in FIG. 2 by storage 269. Computer storage media may include volatile and nonvolatile, removable and non-removable media implemented in any method or technology for storage of information, such as computer readable instructions, data structures, program modules, or other data.

According to embodiments of the invention, when a word or phrase requires text-to-speech conversion or speech recognition, a search of a word lexicon associated with the TTS system 268A or speech recognition system 268B is conducted. If a matching word is found, the matching word is converted to an audible form, or recognition is performed on the matching word. If a matching word is not found, locale data for the word requiring pronunciation is determined. The locale data for a word or phrase ("word/phrase locale") may be garnered from a device 100 and user locale on the device, for example, data contained for a user on his/her mobile computing device 100 that identifies the locale of the user/device. Locale data for the word or phrase may also be garnered from a document maintained or processed on the device 100 (in the case of strongly typed or formatted documents). Locale data for the word or phrase may also be garnered from contextual data (for example, a name from a user's contacts with an address in another country known to speak a foreign language). If the locale of the word requiring pronunciation matches a locale for the TTS and/or speech recognition systems, then a letter-to-speech (LTS) rules system is utilized for creating an audible form of the word or for recognizing the word.

If the locale for the word requiring pronunciation is different from a locale of a TTS and/or speech recognition system in use, a lexicon service 267 is queried to obtain a mapping of the phonemes associated with the word requiring pronunciation to corresponding phonemes of the language associated with the TTS and/or speech recognition system responsible for translating the word from text-to-speech or for recognizing the word. The phonemes associated with the language of the TTS and/or speech recognition system to which the phonemes of the incoming word are mapped are then used for generating an audible form of the incoming word or for recognizing the incoming word based on a pronunciation of the incoming word that may be understood by the TTS and/or speech recognition system that is in use.

If a word or phrase fails to be found via the lexicon service 267, the TTS system or SR system will then apply the LTS rules, as described below. According to embodiments, the LTS rules are based on a large variety of training data that "teaches" the TTS system or SR system how to say words or recognize words and result in a neural net or hidden Markov model which gives a best-guess for pronunciation to the TTS system or SR system.

Figure 3:
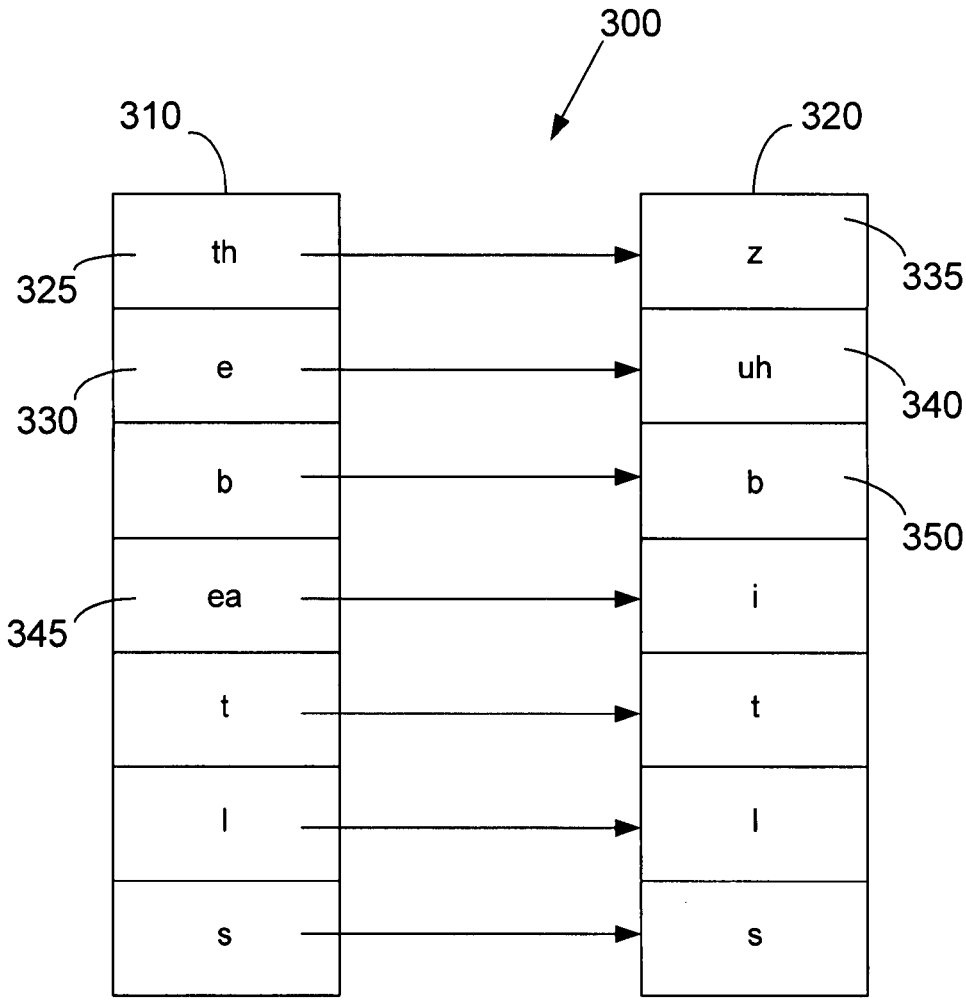
FIG. 3 is a simplified block diagram of a mapping of phonemes associated with a word or phrase written or spoken in a starting language to associated phonemes of a target language.

FIG. 3 is a simplified block diagram of a mapping of phonemes associated with a word or phrase written or spoken in a starting language to associated phonemes of a target language. The phoneme mapping 300, shown in FIG. 3, illustrates the mapping of English language phonemes comprising the English language phrase "The Beatles" to corresponding German language phonemes for generating a German language phoneme compilation that may be used by a German language based text-to-speech (TTS) system 268A or a German language-based speech recognition system for providing an audible version of the subject phrase via a German language based computing device 100. As should be appreciated, the English-to-German example and the example phrase, described herein, are for purposes of illustration only and are not limiting the vast number of different starting languages and target or ending languages that may be used according to embodiments described herein.

Referring still to FIG. 3, the English language phrase "The Beatles," the name of a famous British music group, is broken into phonemes comprising the phrase in the English language table 310. For example, the phonemes "th," "e," "b," "ea," "t," "l," and "s" are generated in table 310 for the English-language phrase "The Beatles." According to embodiments of the invention, in order to generate a phoneme-based text string that may be recognized by a target language-based TTS and/or speech recognition system, a mapping of the phonemes comprising the starting language word/phrase is performed to corresponding phonemes of any ending or target language. Referring then to FIG. 3, a German language phoneme table 320 is illustrated for containing a mapping of phonemes in the target language, for example, German, that correspond to phonemes comprising the beginning or target language, for example English. As should be appreciated, the mapping described above, and illustrated in FIG. 3, is for purposes of causing the target language TTS and/or speech recognition system to generate an audible form of the incoming word or phrase that sounds like the word or phrase would sound according to the beginning language, for example, English.

As illustrated in FIG. 3, the English language phoneme "th" maps to a corresponding German language phoneme of "z," the English language phoneme "e" maps to a corresponding German language phoneme of "uh," the English language phoneme "b" maps to a German language phoneme "b," the English language phoneme "ea" maps to a German language phoneme "i," and so on. By mapping the phonemes comprising an incoming word or phrase from a language of the incoming word or phrase to corresponding phonemes understood by a target language, a TTS and/or speech recognition system may generate or recognize audible speech that sounds like the audible speech would sound like according to the starting language. Thus, as illustrated in FIG. 3, the English-language phrase "The Beatles" will be converted to an audible phrase or will be recognized by a German language TTS and/or speech recognition system as "Za Beatles." As evident from the example described herein, a perfect mapping of the English language phonemes comprising the English language phrase "The Beatles" is not accomplished to corresponding German language phonemes because the phoneme "th" is not a phoneme used in the German language. However, according to the mapping illustrated in FIG. 3, a close approximation is generated by the target language TTS and/or speech recognition system because the outcome of "Za Beatles" is a close approximation to "The Beatles" and is dramatically better than an outcome of "Za Bay-tuls" as may be provided without the phoneme mapping operation, described herein.

As should be appreciated, embodiments of the present invention are equally applicable to speech recognition systems because if it is desired that a speech recognition system recognizes an English language phrase such as "The Beatles" as "Za Beatles," but a German language based speech recognition system expects to hear "Za Bay-tuls," then the speech recognition system will be confused and will not recognize the speech input as the correct phrasing "The Beatles" or the approximation of "Za Beatles." Instead, the speech recognition system will expect "Za Bay-tuls" and will be unable to properly recognize the received spoken input.

The population of the phoneme mapping tables may be either hand-generated or machine generated. Machine generation may be done in one of several ways. A first machine generation method includes mapping of linguistic features, such as type of phoneme (nasal, vowel, glide, etc), positioning (initial, middle, terminal, etc), and other features or linguistic data. According to a second machine generation method, neural nets trained after being fed phoneme inputs from both languages. Other feedback mechanisms, such as naïve mapping extended by end-user feedback may be used for adjusting mapping tables. In practice, a combination of both hand-generation and machine generation may be used for generating phoneme mapping tables. The number of tables may be very large and may be governed by the equation: $N=L^2-L$, where N is the number of tables and L is the number of locales between which translation should be accomplished. The mapping tables have dimensions m by n, where m is the number of phonemes in the source language and n the number in the destination language.

According to an embodiment, an alternate phoneme mapping operation may be performed that does not map phonemes from a starting language to a target language on a one-to-one basis, as illustrated in FIG. 3. According to this embodiment, additional contextual data may be used in an alternate phoneme mapping operation. For example, a previous or next phoneme before or after a subject phoneme in a starting language word or phrase may contribute to a determination of which phoneme in a target language should be selected for mapping to the subject starting language phoneme. For instance, referring to FIG. 3, for the English language word "The," the mapping of the "e" following the phoneme "th" may be different than the mapping of the phoneme "e" when it follows the phoneme "b," as illustrated for the word "Beatles." That is, the context of individual phonemes relative to other phonemes in the starting language word or phrase may allow a more intelligent mapping to target language phonemes than may be generated in a one-to-one phoneme mapping operation. As should be appreciated, using a mapping operation other than one-to-one mapping may change the number of mapping tables that are generated.

In addition, the phoneme mapping operation described herein, may alternatively include diphone or triphone mapping from a starting language to a target or ending language. In phonetics, where a phone includes a speech segment, a diphone may include two adjacent phones or speech segments. According to embodiments, the phoneme mapping operation described herein may alternatively include breaking a starting word or phrase into diphones and mapping the starting diphones to diphones of the target language. Similarly, triphones, which may consist of three adjacent phones or three combined phonemes, may be mapped from a starting language word to a target or ending language word or phrase. Such triphones add a context-dependent quality to the mapping operation and may provide improved speech synthesis. For example, if the English language word "the" is mapped on a one-to-one basis based on the phonemes or phones associated with the letters "t," "h," and "e," the mapping result may not be as good as a result of a mapping of the combination of "th" and "e," and a mapping of the phones or phonemes of the combined "the" may result in yet a better mapping depending on the availability of a phoneme/diphone/triphone in the target language to which this combination of speech segments may be mapped. According to an embodiment, then, phoneme mapping described and claimed herein includes the mapping of phonemes, diphones, triphones, or any other context-independent or context-dependent speech segments or combination of speech segments that may be mapped from a starting language to a target or ending language.

Having described operating environments for and architectural aspects of embodiments of the present invention above with reference to FIGS. 1-3, it is advantageous to further describe embodiments of the present invention with respect to an example operation. For purposes of describing FIGS. 4 and 5 below, consider for example that a user of a German language based mobile computing device 100, for example, a personal digital assistant is listening to one or more songs that are stored on her mobile computing device 100. At the beginning or end of the playing of a particular song, a text-to-speech audible message or presentation is provided to the user over a speaker associated with the mobile computing device 100, for example, a head set, earphone, remote speaker, and the like, that provides the user a title of the song and the name of the recording artist in a language associated with the user's mobile computing device 100. For example, if the user's mobile computing device 100 is configured according to the German language, then the title of a song and an identification of the associated recording artist may be provided to the user in German.

According to the example used herein, the name of a recording artist, for example, "The Beatles" will not be translated into German, because the name of the recording artist is a proper name for the recording artist, and thus, according to embodiments, the text-to-speech and/or speech recognition systems available to the mobile computing device 100 will provide a German language audible identification of the title of the song, but will provide an audible presentation of the recording artist according to the language associated with the recording artist, for example, English. As should be appreciated, the example operation, described herein, is for purposes of illustration only, and the embodiments of the present invention are equally applicable to correcting pronunciation of TTS and/or speech recognition systems in any context in which information according to a first language is passed to a TTS and/or SR system operating according to a second language.

Figure 4:
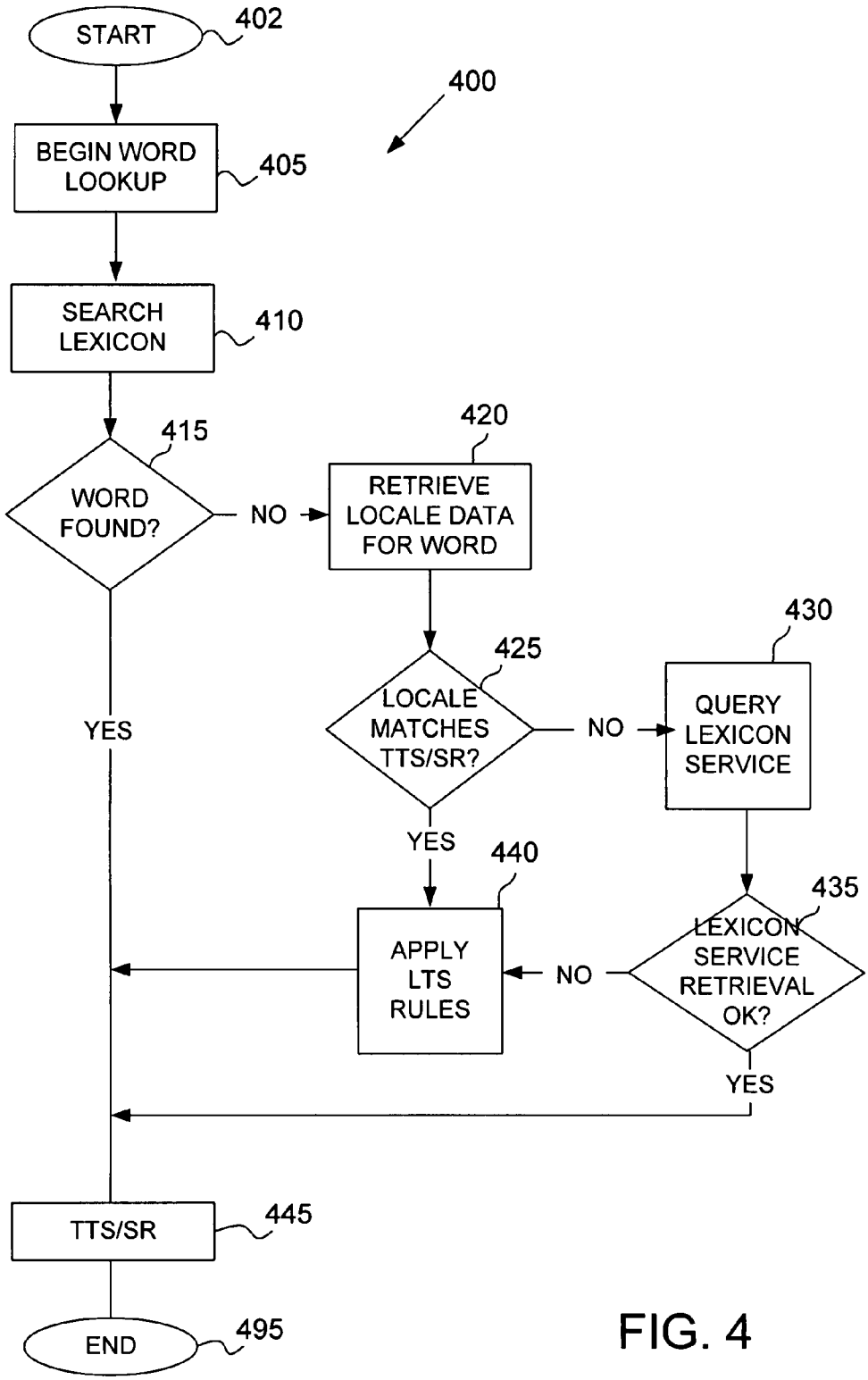
FIG. 4 is a logical flow diagram illustrating a method for correcting pronunciation of a text-to-speech system and/or speech recognition system between different spoken languages.

FIG. 4 is a logical flow diagram illustrating a method for correcting pronunciation of a text-to-speech system and/or a speech recognition system between different spoken languages. The method 400 begins at start operation 402 and proceeds to operation 405 where a word pronunciation look-up is initiated for a given word or phrase. According to the example illustrated and described herein, consider that the song "She Loves You" by the British music group "The Beatles" has been played on the user's mobile computing device 100, and the mobile computing device 100 is configured according to the German language. After the song is played, the programming of the music player application in use provides an audible presentation of the title of the song according to the language associated with the mobile computing device 100 and an audible presentation of the recording artist according to the language associated with the recording artist, for example, English. Thus, at operation 405, the title of the song "She Loves You" and the name of the example recording artist "The Beatles" are presented by the music program to a TTS system 268A for generating a text-to-speech audible presentation of the song title and recording artist.

Referring still to operation 405, as should be appreciated, the beginning word or phrase passed to the TTS and/or speech recognition system by the user's mobile computing device will be passed to those systems according to the language associated with the mobile computing device. Thus, for the present example, consider that the German translation of the phrase "She Loves You by 'The Beatles'" is "Sie Liebt Dich durch 'The Beatles.'" Thus, according to this example, the incoming word or phrase includes words or phrases from two different languages. The first four words of this phrase are according to the German language and the last two words of the phrase are according to the English language.

At operation 410, the phrase "Sie Liebt Dich durch 'The Beatles'" is passed to a word lexicon operated by the pronunciation correction system 266 on the example German language based mobile computing device 100 for determining whether any of the words in the incoming phrase are located in the word lexicon. As should be appreciated the word/phrase lexicon to which the incoming words are passed is based on the language in use by the TTS/SR systems on the machine in use. Thus, at operation 410, the incoming phrase "Sie Liebt Dich durch 'The Beatles'" is passed to the example German language lexicon, and at operation 415, a determination is made as to whether any of the words in the phrase are found in the German language lexicon. According to the illustrated example, the words "Sie Liebt Dich durch" which translate to the English phrase "She Loves You by" are found in the German language lexicon because the words "Sie," "Liebt," "Dich," and "durch" are common words that are likely available in the German language lexicon. However, if at operation 415 if any of the words in the incoming phrase are not located in the example German language lexicon, then the routine proceeds to operation 420. For example, the words "The Beatles" may not be in the German language lexicon because the words are associated with a different language, for example, English.

At operation 420, the pronunciation correction system 266 retrieves language locale data for the word or phrase that was not located in the word lexicon. For example, if the words "The Beatles" were not located in the word lexicon at operation 410, then locale data for the words "The Beatles" is retrieved at operation 420. For example, by determining that the word or phrase not found in the word lexicon is associated with a locale of United Kingdom, then a determination may be made that a language associated with the word or phrase is likely English.

According to embodiments, language locale information for the word or words not found in the word lexicon may be determined by a number of means. For example, a first means for determining locale information for a given word includes parsing metadata associated with a word to determine a locale and corresponding language associated with the word. For example, the song title and artist identification may have associated metadata that describes a publishing company, publishing company location, information about the artist, location of production, and the like. For example, metadata associated with the words "The Beatles" may be available in the data associated with the song that identifies the words "The Beatles" as being associated with the English language.

A second means for determining locale information includes comparing the subject word or words to one or more databases including locale information about the words. For example, a word may be compared with words contained in a contacts database for determining an address or other locale-oriented language associated with a given word. An additional means for determining locale information includes passing a given word to an application, for example, an electronic dictionary or encyclopedia for obtaining locale-oriented information about the word. As should be appreciated, any data that may be accessed locally on the computing device 100 or remotely via a distributing computing network by the pronunciation correction system 266 may be used for determining identifying information about a given word or words including information that provides the system 266 with a locale associated with a given language, for example, English, French, Russian, German, Italian, and the like.

At operation 425, after the pronunciation correction system 266 determines a locale, for example, the United Kingdom, and an associated language, for example, English, for the words not found in the example German lexicon, the method proceeds to operation 425, and a determination is made as to whether the locale for the subject words matches a locale for the TTS and/or SR systems in use, for example, the German based TTS and/or SR systems, illustrated herein. If the locale of the words not found in the word lexicon matches a locale for a the TTS and/or SR system in use, the method proceeds to operation 440, and a letter-to-speech (LTS) rules system is applied to the subject words for the target language, for example, German, and the resulting LTS output is passed to the TTS and/or SR systems for generating an audible presentation of the subject word or words or for recognizing the subject word or words.

Because of the vast number of words associated with any given language, some words may not be found the word lexicon at operation 410 even though the locale for the words is the same as the TTS and/or SR systems in use by the mobile computing device 100. That is, a German word may be passed to a German word lexicon and may not be found in the word lexicon, but nonetheless, the word belongs to the same locale. In this case, the word or words are placed in a form for text-to-speech conversion or speech recognition according to the LTS rules associated with the target language, for example, German.

Referring back to operation 425, if the locale of the words not found in the word lexicon does not match the locale of the TTS and/or SR system responsible for recognizing the words or for converting the words from text to speech, the method proceeds to operation 430 and the lexicon service 267, described below with reference to FIG. 5, generates a phoneme-based version of the word or words according to the target language, for example, German, that may be understood by the target TTS and/or SR system responsible for generating a TTS audible presentation or for recognizing the incoming word or words. At operation 435, if the lexicon service is not successful in generating a phoneme-based version of the words not found in the word lexicon, the routine proceeds back to operation 440, and the letter-to-speech (LTS) rules for the target language are applied to the subject words, and the resulting information is passed to the TTS and/or SR systems for processing, as described herein. The method 400 ends at operation 495.

As described above, if the locale for the words not found in the lexicon does not match the locale of the TTS/SR systems 268A, 268B, the words are passed to the lexicon service 267 for phoneme mapping. Referring to FIG. 5, operation of the lexicon service/method 267 begins at start operation 505 and proceeds to operation 510 where a lexicon lookup service for the words not found in the word lexicon at operation 410, FIG. 4, are processed for generating a phoneme-based output that may be processed by the TTS and/or SR systems associated with the target language. For example, at operation 510, the words "The Beatles" that were not found in the word lexicon lookup at operation 410, FIG. 4, and for which the locale information, for example, English, did not match the locale information for the TTS and/or SR systems, for example, German are passed to the lexicon lookup service.

At operation 520, the pronunciation correction system (PCS) 266 queries a database of word lexicons and LTS rules for various languages and obtains a word lexicon and LTS rules set for each of the subject languages involved in the present pronunciation correction operation. For example, if the incoming language associated with the words not found in the word lexicon at operation 410, FIG. 4, are English language words, and the TTS and/or SR systems 268A, 268B for the user's computing device 100 are German language systems, then the pronunciation correction system 266 will obtain word lexicons and LTS rules sets for the incoming language of English and for the target or destination language of German. According to one embodiment, the lexicons are loaded by the pronunciation correction system 266 to allow the PCS 266 to know how to translate incoming phonemes associated with the subject words from the incoming language to the target language. That is, the word lexicons obtained for each of the two languages contain phonemes associated with the respective languages in addition to a collection of words and/or phrases.

The LTS rules sets for each of the two languages may be loaded by the pronunciation correction system 266 to allow the system 266 to know which phonemes are available for each of the target languages. For example, the LTS rules set for the German language will allow the pronunciation correction system 266 to know that the phoneme "th" from the English language is not available according to the German language, but that an approximation of the English language phoneme "th" is the German phoneme "z."

At operation 520, the pronunciation correction system 266 searches the locale-specific word lexicon associated with the starting language, for example, English, to determine whether the subject word or words are contained in the locale-specific lexicon associated with the starting language. For example, at operation 520, a determination may be made whether the example words "The Beatles" are located in the locale-specific word lexicon associated with the English language. At operation 525, if the subject words, for example, "The Beatles" are found in the locale-specific word lexicon for the starting language, the routine proceeds to operations 535 and 540 for generation of the phoneme mapping tables, described above with reference to FIG. 3. If the subject word or words are not located in the locale-specific word lexicon for the starting language, the routine proceeds to operation 530, and the LTS rules set for the locale-specific starting language are applied to the subject word or words for generating an LTS output for use in generating the phoneme mapping tables.

At operation 535, a phoneme mapping table 310 is generated for the incoming or starting words, for example, the words "The Beatles" according to the incoming or starting language, for example, English, as described above with reference to FIG. 3. At operation 540, a one-to-one mapping between starting language phonemes comprising the subject words is made to corresponding phonemes of the destination or target language, for example, German. At operation 545, a lookup table may be used for mapping phonemes comprising the subject words according to the starting or incoming language to corresponding phonemes of the target or destination language. For example, a lookup table may be generated, as described above, for mapping phonemes from any starting language to corresponding phonemes, if available, in a target or destination language. For example, referring to FIG. 3, the phoneme "th" 325 in the English phoneme mapping table 310 is mapped to the phoneme "z" 335 in the German phoneme mapping table 320 for the words "The Beatles."

At operation 550, the phoneme mapping data contained in the target phoneme mapping table 320, as illustrated in FIG.

3, is passed to the LTS rules set for the target language at operation 440 (FIG. 4) where it is used to generate a text-to-speech audible presentation of "Za Beatles" as an approximation of the English language words "The Beatles." The method 500 ends at operation 595.

Figure 5:
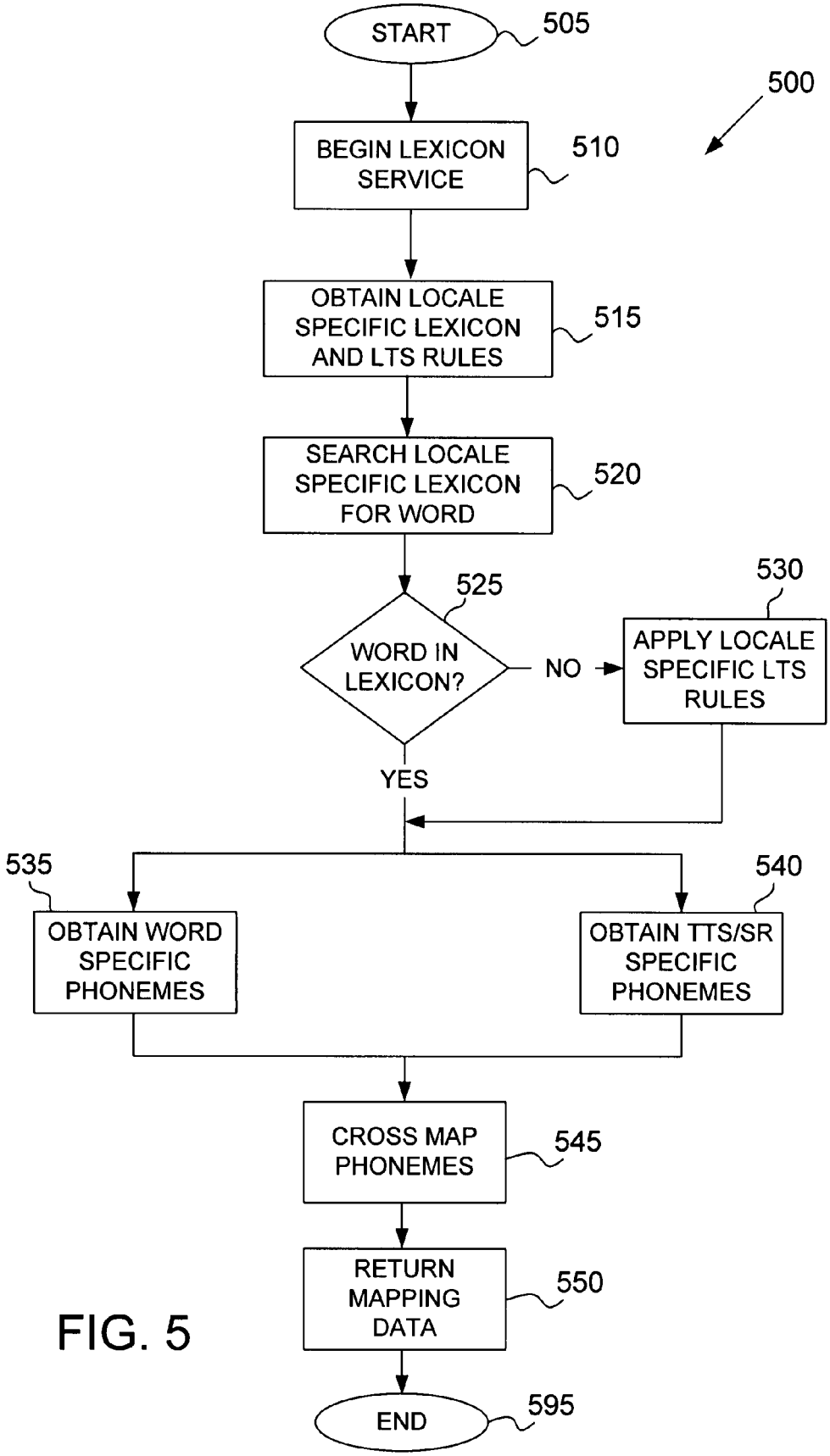
FIG. 5 is a logical flow diagram illustrating a method for correcting pronunciation of a text-to-speech system and/or speech recognition system between different spoken languages.

Continuing with the example described herein with reference to FIGS. 4 and 5, the example text string comprising the song title and recording artist "Sie Liebt Dich durch 'The Beatles'" will be processed, as described above, and the TTS system 268A operated by the computing device 100 will generate an audio presentation to be played to the user as "Sie Liebt Dich durch 'Za Beatles.'" Similarly, if a user wishes to command her computing device 100 and associated music player application to play the song by issuing a spoken command of "Sie Liebt Dich durch 'The Beatles,'" the corresponding phrasing of "Sie Liebt Dich durch 'Za Beatles'" which will be expected by the speech recognition system 268B of the German language based computing device 100, and thus, the German language based speech recognition system will not be confused by the words "The Beatles" because those words will be processed, as described herein, to the form of "Za Beatles" which will be understood based on the phoneme mapping, illustrated in FIGS. 3 and 5.

It will be apparent to those skilled in the art that various modifications or variations may be made in the present invention without departing from the scope or spirit of the invention. Other embodiments of the present invention will be apparent to those skilled in the art from consideration of the specification and practice of the invention disclosed herein.

We claim:

1. A method of correcting pronunciation generation of a language pronunciation system, comprising:

receiving a word according to an incoming language requiring electronic pronunciation according to a target language;

determining whether the word requiring electronic pronunciation is a word of the target language;

if the word requiring electronic pronunciation is not a word of the target language, retrieving a language locale for the word;

determining whether the language locale for the word matches a language locale for a pronunciation system responsible for converting the word to speech or recognizing a spoken form of the word;

generating a number of phoneme mapping tables, the number of phoneme mapping tables being governed by $N=L^2-L$, wherein N comprises the number of phoneme mapping tables and L comprises a number of the language locales between which translation is accomplished, each of the language locales comprising a country known to speak a foreign language;

if the language locale for the word does not match the language locale for a pronunciation system responsible for converting the word to speech or for recognizing an audible form of the word, mapping phonemes comprising the word according to the incoming language to corresponding phonemes associated with the target language, wherein mapping the phonemes comprises mapping at least one diphone from the incoming language to at least one diphone in the target language, the at least one diphone comprising two adjacent speech segments, the two adjacent speech segments comprising two adjacent letters in an actual spelling of the word according to the incoming language, wherein mapping the phonemes further comprises utilizing contextual data, the contextual data comprising at least one of:

at least one of a starting phoneme and a next phoneme before a subject phoneme in the incoming language word, wherein the at least one of the starting phoneme and the next phoneme contributes to the determination of a phoneme in the target language selected for mapping to the subject phoneme in the incoming language word; and at least one of a starting phoneme and a next phoneme after a subject phoneme in the starting language word, wherein the at least one of the starting phoneme and the next phoneme contributes to the determination of a phoneme in the target language selected for mapping to the subject phoneme in the incoming language word; and passing an output of the mapping of phonemes comprising the word according to the incoming language to corresponding phonemes associated with the target language to the pronunciation system for converting the word to speech or for recognizing an audible form of the word.

2. The method of claim 1, wherein determining whether the word requiring electronic pronunciation is a word of the target language includes passing the word to a word lexicon associated with the target language to determine whether the word is contained in the word lexicon of the target language.

3. The method of claim 1, wherein retrieving language locale for the word includes parsing metadata associated with a word to determine a language locale and corresponding language associated with the word.

4. The method of claim 1, wherein retrieving language locale for the word includes comparing the word to one or more databases including language locale information about the word.

5. The method of claim 1, wherein retrieving language locale for the word includes passing the word to a database of information about words for finding a language locale for the word.

6. The method of claim 1, wherein prior to mapping phonemes comprising the word according to the incoming language to corresponding phonemes associated with the target language, further comprising:

retrieving a word lexicon associated with the incoming language and a language-to-speech (LTS) rules set associated with the incoming language, and retrieving a word lexicon associated with the target language and an LTS rules set associated with the target language; and determining from the word lexicon and LTS rules sets associated with each of the incoming language and the target language how to map phonemes from the incoming language to the target language.

7. The method of claim 1, wherein passing an output of the mapping of phonemes comprising the word according to the incoming language to corresponding phonemes associated with the target language to the pronunciation system for converting the word to speech or for recognizing an audible form of the word, includes passing the mapping to a text-to-speech system operative to convert text to speech for generating an audible output from the mapping.

8. The method of claim 1, wherein passing an output of the mapping of phonemes comprising the word according to the incoming language to corresponding phonemes associated with the target language to the pronunciation system for converting the word to speech or for recognizing an audible form of the word, includes passing the mapping to a speech recognition system operative to recognize audible input corresponding to the mapping.

9. A tangible computer readable storage medium containing computer executable instructions which when executed by a computer perform a method of correcting pronunciation generation of a language pronunciation system, comprising: receiving a word according to an incoming language requiring electronic pronunciation according to a target language; determining whether the word requiring electronic pronunciation is a word of the target language; if the word requiring electronic pronunciation is not a word of the target language, retrieving language locale for the word; determining whether a language locale for the word matches a language locale for a pronunciation system responsible for converting the word to speech or recognizing a spoken form of the word; if a language locale for the word matches a language locale for a pronunciation system responsible for converting the word to speech or for recognizing an audible form of the word, applying a letter-to-speech (LTS) rules system associated with the target language to the word for generating an audible form of the word according to the LTS rules system; passing an output of the application of the LTS rules associated with the target language to the word to the pronunciation system for converting the word to speech or for recognizing an audible form of the word; generating a number of phoneme mapping tables, the phoneme mapping tables having dimensions m by n, where m is a number of phonemes in a source language and n is a number of phonemes in the target language; if a language locale for the word does not match a language locale for a pronunciation system responsible for converting the word to speech or for recognizing an audible form of the word, mapping phonemes comprising the word according to the incoming language to corresponding phonemes associated with the target language; and passing an output of the mapping of phonemes comprising the word according to the incoming language to corresponding phonemes associated with the target language to the pronunciation system for converting the word to speech or for recognizing an audible form of the word.

10. The tangible computer readable storage medium of claim 9, wherein passing an output of the application of the LTS rules associated with the target language to the word to the pronunciation system for converting the word to speech or for recognizing an audible form of the word, includes passing the output to a speech recognition system operative to recognize audible input corresponding to the application of the LTS rules.

11. The tangible computer readable storage medium of claim 9, wherein passing an output of the application of the LTS rules associated with the target language to the word to the pronunciation system for converting the word to speech or for recognizing an audible form of the word, includes passing the output to a text-to-speech system operative to convert text to speech for generating an audible output from the application of the LTS rules.

12. A tangible computer readable storage medium containing computer executable instructions which when executed by a computer perform a method of correcting pronunciation generation of a language pronunciation system, comprising: receiving a word according to an incoming language requiring electronic pronunciation according to a target language; determining whether the word requiring electronic pronunciation is a word of the target language; if the word requiring electronic pronunciation is not a word of the target language, retrieving language locale for the word; determining whether a language locale for the word matches a language locale for a pronunciation system responsible for converting the word to speech or recognizing a spoken form of the word; generating a number of phoneme mapping tables, the number of phoneme mapping tables being governed by $N=L^2-L$, wherein N comprises the number of phoneme mapping tables and L comprises a number of the language locales between which translation is accomplished, each of the language locales comprising a country known to speak a foreign language; if a language locale for the word does not match a language locale for a pronunciation system responsible for converting the word to speech or for recognizing an audible form of the word, mapping phonemes comprising the word according to the incoming language to corresponding phonemes associated with the target language; and passing an output of the mapping of phonemes comprising the word according to the incoming language to corresponding phonemes associated with the target language to the pronunciation system for converting the word to speech or for recognizing an audible form of the word.

13. The tangible computer readable storage medium of claim 12, wherein determining whether the word requiring electronic pronunciation is a word of the target language includes passing the word to a word lexicon associated with the target language to determine whether the word is contained in the word lexicon of the target language.

14. The tangible computer readable storage medium of claim 12, wherein retrieving language locale for the word includes parsing metadata associated with a word to determine a language locale and corresponding language associated with the word.

15. The tangible computer readable storage medium of claim 12, wherein retrieving language locale for the word includes comparing the word to one or more databases including language locale information about the word.

16. The tangible computer readable storage medium of claim 12, wherein retrieving language locale for the word includes passing the word to a database of information about words for finding a language locale for the word.

17. The tangible computer readable storage medium of claim 12, wherein prior to mapping phonemes comprising the word according to the incoming language to corresponding phonemes associated with the target language, further comprising: retrieving a word lexicon associated with the incoming language and a language- to-speech (LTS) rules set associated with the incoming language, and retrieving a word lexicon associated with the target language and an LTS rules set associated with the target language; and determining from the word lexicon and LTS rules sets associated with each of the incoming language and the target language how to map phonemes from the incoming language to the target language.

18. The tangible computer readable storage medium of claim 12, wherein passing an output of the mapping of phonemes comprising the word according to the incoming language to corresponding phonemes associated with the target language to the pronunciation system for converting the word to speech or for recognizing an audible form of the word, includes passing the mapping to a text-to-speech system operative to convert text to speech for generating an audible output from the mapping.

19. The tangible computer readable storage medium of claim 12, wherein passing an output of the mapping of phonemes comprising the word according to the incoming language to corresponding phonemes associated with the target language to the pronunciation system for converting the word to speech or for recognizing an audible form of the word, includes passing the mapping to a speech recognition system operative to recognize audible input corresponding to the mapping.

* * * * *